United States Patent [19]

Rice et al.

[11] 4,450,046

[45] May 22, 1984

[54] METHOD FOR INCREASING THE WET BULK DENSITY OF COKING COALS

[75] Inventors: David A. Rice, Hellertown; Robert R. Greenbaum, Coopersburg; Thomas J. Conarty, Jr., Lehighton, all of Pa.

[73] Assignee: Bethlehem Steel Corp., Bethlehem, Pa.

[21] Appl. No.: 388,000

[22] Filed: Jun. 14, 1982

[51] Int. Cl.[3] ..... C10B 57/06; C10B 57/08

[52] U.S. Cl. ..... 201/20; 44/6; 201/41; 252/88

[58] Field of Search ..... 201/9, 20, 23, 41; 44/6; 252/88; 23/293 R

[56] References Cited

U.S. PATENT DOCUMENTS

| | | | |
|---|---|---|---|
| 2,378,420 | 6/1945 | Lohr et al. | 201/23 |
| 3,563,714 | 2/1971 | Brewer | 44/6 |
| 4,171,276 | 10/1979 | Brehm | 252/88 |
| 4,225,317 | 9/1980 | Kugel | 44/6 |
| 4,304,636 | 12/1981 | Kestner et al. | 201/20 |
| 4,369,121 | 1/1983 | Callahan et al. | 252/88 |

FOREIGN PATENT DOCUMENTS

| | | | |
|---|---|---|---|
| 1946168 | 3/1971 | Fed. Rep. of Germany | 252/88 |
| 25-40491 | 4/1950 | Japan | 252/88 |

OTHER PUBLICATIONS

McCutcheon's Detergents & Emulsifiers; 1980 N. American Ed.; pp. 158–161.

*Primary Examiner*—Bradley Garris

*Attorney, Agent, or Firm*—John I. Iverson; William B. Noll; John J. Selko

[57] ABSTRACT

A method for increasing the wet bulk density of coking coal charges for code ovens which charges contain at least about 6 and as much as 13 weight percent moisture, to an optimum level of between about 47 and 50 pounds per cubic foot (753 to 801 kg per cubic meter) and for controlling and maintaining the bulk density at such optimum levels, the method including:

(a) forming a 5 to 20 weight percent aqueous dispersion of a surfactant having a desired viscosity, and (b) applying a quantity of the aqueous dispersion to a quantity of coal equivalent to between about 0.5 and 2.5 pounds (0.227 and 1.135 kg) of surfactant per ton (907.2 kg) of coal, the surfactant being an alkylphenoxypoly (ethyleneoxy) ethanol having a general formula:

where

R is an alkyl group having between about 8 and 12 carbon atoms, and n is an integer between 2 and 30, and is characterized by an HLB number in the range of about 4 and 18.

8 Claims, 1 Drawing Figure

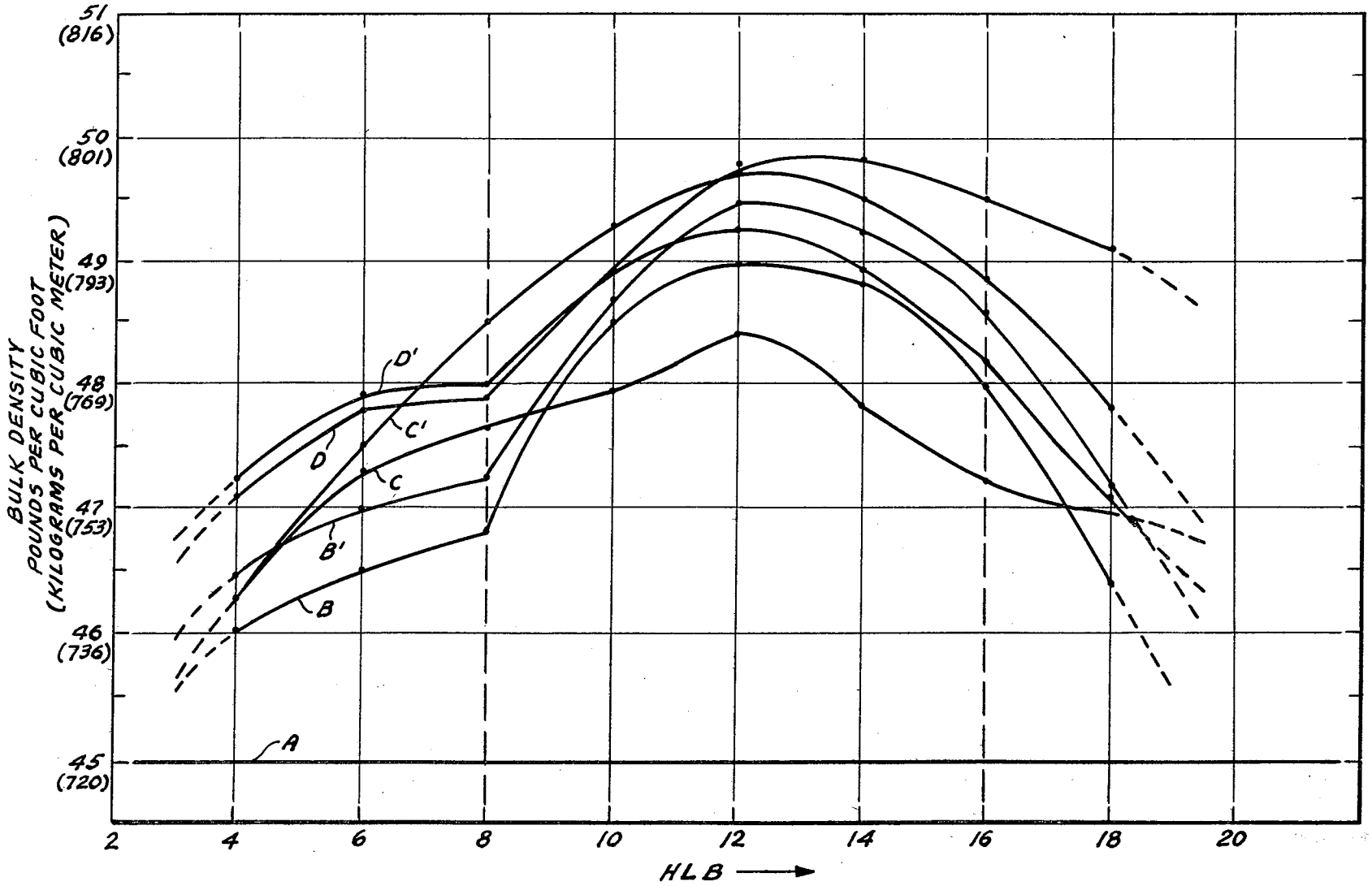
BULK DENSITY
POUNDS PER CUBIC FOOT
(KILOGRAMS PER CUBIC METER)
51 (816)
50 (801)
49 (793)
48 (769)
47 (753)
46 (736)
45 (720)
2
4
6
8
10
12
14
16
18
20
HLB
A
B
B'
C
C'
D
D'

METHOD FOR INCREASING THE WET BULK DENSITY OF COKING COALS

BACKGROUND OF THE INVENTION

This invention in general relates to a method for increasing the bulk density of moist coking coals to an optimum level and for controlling and maintaining the bulk density of the moist coals at such optimum levels. The method is particularly adapted to coals which contain between about 6 and 13 weight percent moisture.

The vast reserves of quality metallurgical grade coking coals are being rapidly depleted. Efforts to slow down the depletion of these coals have included upgrading the method of washing and preparing the coals so that the fine raw coal produced from continuous mining can be beneficiated to improve the coal chemistry by the removal of increasing amounts of sulfur and ash; and to recover more of the fine coal particles which in the past were normally wasted to refuse piles. Upgrading of these old processes included adding new steps to improve the beneficiation of the coals. As a result, the moisture content of the coals has increased from an average moisture of about 4 and 5 weight percent to between about 7 to 10 weight percent or more over the past twenty years. Generally, the moisture increase is found in the finer coal sizes shipped from the coal preparation plants.

The beneficiated coal is coked in coke ovens designed to operate at a maximum wall pressure of 13.8 K Pa. The coke produced must not be friable and have sufficient strength to resist degradation during transport and during charging and to support the burden in the blast furnace. To maximize production in the coke ovens with the most efficient use of the energy supplied to the coke ovens and to maintain minimum strain on the walls of the oven, it is essential that the bulk density of the coal be measured and controlled.

All as-received coal contains some moisture for example as little as 2% and as much as 13% or higher. For this reason, it is the usual practice to measure the bulk density of coal as its wet bulk density. The wet bulk density of coal is determined by a standard ASTM D291-60 test procedure or modifications thereof. In the test, a quantity of coal is allowed to fall into a container of known volume. The container filled with coal is weighed. The bulk density is given in weight per unit volume, i.e. pounds per cubic foot or kilograms per cubic meter. The dry bulk density is not determined directly. It is the practice to calculate the dry bulk density of coal from the known wet bulk density and the amount of moisture in the coal.

Both the measured wet bulk density and the calculated dry bulk density of coking coals are of practical importance in the operation of coke ovens. On the one hand, the measured wet bulk density is important in the control of oven filling since for the most part, ovens are filled by gravity feed from hoppers of known volume or by volumetric devices such as screw feeders. In this case, the wet bulk density is needed to control the filling of the oven itself as it is well known that oven underfilling can result in production losses and excessive roof carbon formation. Overfilling of the oven can result in fires, excessive emissions during charging and the production of improperly carbonized coke. On the other hand, the calculated dry bulk density and analytically determined moisture are important in the control of the energy supply to the coke ovens and the production of the coke itself. This relationship between wet and dry bulk density (i.e. the dry bulk density is the weight of dry coal per cubic foot of moist coal) is well known in the art, and should be considered throughout the remainder of this document.

Generally, the bulk density of dry coal is between 53 and 60 pounds per cubic foot (849 and 961 Kg per cubic meter) dependent upon the degree of pulverization and type of coal.

The dry bulk density of the coal decreases as the moisture increases and may be reduced to as low as 38 to 41 pounds per cubic foot (609 to 656 kg per cubic meter, respectively) when the moisture content reaches about 8 weight percent. However, in the range of 8 to 13 weight percent moisture, the dry bulk density of the coals increases slightly to about 42 to 43 pounds per cubic foot (673 to 689 kg per cubic meter). While the dry bulk density does increase with increased moisture content, such additional moisture affects the coking process and additional heat is required to vaporize the moisture. Coke production decreases. Additionally, the coke produced from such moist coal may be weak.

Attempts to offset the deleterious effect of small amounts of moisture on the bulk density of coals have centered on the application of materials which negate the adherence of the water to the coals. It is a known practice to apply small amounts of oil, for example #2 fuel oil, to the surfaces of the coals to increase the bulk density of the coals. Oils so applied do increase the bulk density of coals containing small amounts of moisture, for example between about 2 to 6 weight percent of water. At these moisture levels, the use of fuel oil results in displacement of free water from the surfaces of the coals and thus increases the wet bulk density of the coals. However at relatively high moisture contents, for example about 6 to 8 weight percent and higher, the effect of oil on the bulk density of coals decreases, i.e. large quantities of oil are required for minimal increase in wet bulk density. At moisture contents higher than 8 weight percent, the addition of oil may actually result in a decrease in the wet bulk density of the coals. Then, too, at moisture contents of 2 to 6 percent, the use of the fuel oil does significantly increase the wet bulk density of coal mixes, however at a constant fuel oil treatment rate, small changes in the moisture content can cause wide fluctuations in the wet bulk density of the coals which fluctuations are quite sharp and can result in wet bulk density control problems. Such problems are serious because as noted above, coke ovens are designed to operate at a maximum wall pressure of about 2 pounds per square inch (13.8 K Pa) and coals having very high bulk density may expand excessively during coking resulting in damage to the refractory walls of the oven. The recent rapid rise in the cost of oil products has made the use of oils at high application rates unattractive from a commercial viewpoint.

It has been known to use a wetting agent, for example succinates, or to use combinations of water and a wetting agent, per se, or oil and a wetting agent, as described in U.S. Pat. No. 2,378,420 issued June 19, 1945 to F. A. Lohr et al entitled "Regulating the Bulk Density of Coke Oven Charges." Lohr et al teach that moist coals, i.e. coals containing more than 1 weight percent moisture, can be coated with minute quantities of an oil to increase the wet bulk density of the coals. On the other hand, if water is applied to such coals their wet bulk density decreases as the percentage of moisture increases to between 6 and 8 weight percent. It is therefore possible to adjust the wet bulk density of coals by additions of both oil and water.

Lohr, et al also teach that the wet bulk density of coals can be adjusted by spraying the surfaces of the coals with a free flowing liquid containing a wetting agent, for example sulfonated bi-carboxylic acid (dioctyl sodium sulfosuccinate).

As shown by data and examples in the specification, Lohr et al treat coals containing between 0.9 and 4.5 weight percent moisture. There is no teaching in Lohr, et al that the wet bulk density of coals or blends of coals containing from about 6 weight percent to about 13 weight percent moisture can be increased to an optimum level and that such bulk densities can be controlled and maintained by spraying a suitable non-ionic agent on the surfaces of wet coals.

There is, therefore, a need for a simple, efficient, economical method for increasing the wet bulk density of coking coals which have at least about 6 and as much as about 13 weight percent moisture. The method must be commercially attractive and must increase the wet bulk density of such moist coals to an optimum level. Also, the method must be able to control the wet bulk density of the coals at the optimum level to thereby maintain the productivity of the coke ovens and at the same time have no adverse effects on the properties of the coke or the coking process. In addition, there is a need for a simple method of controlling the wet bulk density of coals wherein the wet bulk density variation is small over a wide range of moisture.

It is the primary object of this invention to provide a method for increasing the wet bulk density of moist coals containing at least about 6 weight percent moisture to an optimum level of between about 47.5 and 49.5 pounds per cubic foot (761 and 793 kg per cubic meter) and maintaining the wet bulk density of such coals at the optimum level, wherein the moist coals are sprayed with an amount of a surfactant equal to about 0.5 to 2.5 pounds (0.227 kg to 1.135 kg) of surfactant per ton (907.2 kg) of coal, the surfactant applied in the form of a 5 to 20 weight percent aqueous dispersion of surfactant and being characterized by the general structural formula,

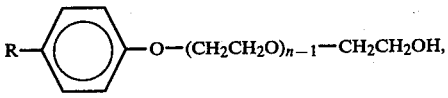

where

R is an alkyl group containing between about 8 and 12 carbon atoms, and n is an integer between 2 and 30, an HLB number within the range of between about 4 and 18.

It is an object of this invention to provide a method for increasing, controlling and maintaining the wet bulk density of coals at an optimum level, which method will be commercially attractive.

It is another object of this invention to provide a method for increasing the wet bulk density of wet coals containing between about 6 to 13 weight percent moisture to an optimum level and maintaining the bulk density at such optimum level whereby the productivity of the coke ovens is maximized without deleteriously affecting the properties of the coke or increasing the pressure applied to the walls of the coke ovens above present design limits.

It is still another object of this invention to provide a method for increasing, controlling and maintaining the wet bulk density of coking coals containing more than about 6 weight percent moisture at an optimum level wherein a quantity of a non-ionic oil-soluble or water-dispersible surfactant is sprayed on the surface of the coals, which surfactant will not adversely affect the coking of the coals or the properties of the coke.

It is still another object of this invention to provide a method for energy savings during coking, since the increase in wet bulk density due to the use of the surfactant will increase the amount of coal charged to the ovens but the amount of fuel required to coke this additional quantity of coal will be minimal.

It is still another object of this invention to provide a method for increasing, controlling and maintaining the wet bulk density of coking coals having moisture contents of at least about 6 weight percent and as much as 13 weight percent at an optimum level wherein the coals or blends of coals are sprayed with an amount of an aqueous dispersion containing a non-ionic surfactant characterized by an HLB number between about 4 and 18.

SUMMARY OF THE INVENTION

Accordingly to this invention, there is provided a method for increasing the wet bulk density of coals containing more than about 6 weight percent moisture to a desired optimum level and maintaining the bulk density of such coals at an optimum level wherein the moist coals are treated, usually by spraying with an amount of an aqueous dispersion of an alkylphenoxypoly (ethyleneoxy) ethanol-type surfactant having the general formula:

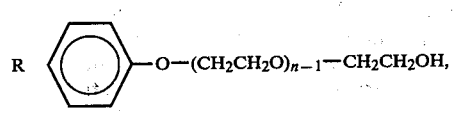

wherein

R is an alkyl group having at least 8 carbon atoms, n is an integer between 2 and 30 and which is characterized by having an HLB number of between about 4 and 18. About 0.5 to about 1.5 gallons per ton (1.89 to 5.68 L per 907.2 kg) of coal of a 5 to 20 percent aqueous dispersion is sprayed on the surfaces of the coals. Applying the surfactant on the surfaces of the coals increases the wet bulk density of coals containing about 6.0 weight percent moisture up to about 13 weight percent moisture from between about 42 and 45 pounds per cubic foot (672 and 720 kg per cubic meter) to between about 47 and 50 pounds per cubic foot (753 and 801 kg per cubic meter). Spraying or otherwise applying the surfactant to the surfaces of the coals not only increases the bulk density of the moist coals but also provides an accurate means to control and maintain the bulk density of the moist coals at an optimum level. The method is particularly adapted for such coals containing moisture within the range of about 6 to 13 weight percent.

FIGURE OF THE INVENTION

The FIGURE is a graph comparing the effect of surfactants on the wet bulk density of coals.

PREFERRED EMBODIMENT OF THE INVENTION

In the preferred embodiment of the method of the invention, an aqueous dispersion of a surfactant is produced by mixing the surfactant with water in quantities sufficient to form a dispersion of about 15 weight percent surfactant. The aqueous dispersion is applied to the surfaces of the coal usually by spraying. The amount of aqueous dispersion sprayed on the coal is equivalent to about 1.5 pounds of surfactant per ton of coal (0.68 kg of surfactant per 907.2 kg of coal) whereby the wet bulk density of the coals is increased by between about 5 and 10 percent from a wet bulk density of about 42 to 45 pounds per cubic foot (672 to 720 kg per cubic meter) to a wet bulk density of about 47 to 50 pounds per cubic foot (752 to 801 kg per cubic meter). The surfactant typically has the following structure:

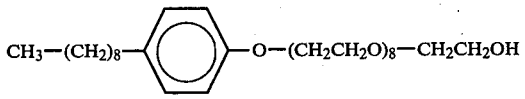

and is characterized by having an HLB number of about 13 and an aqueous cloud point of about 62C for a one percent aqueous solution. When we refer to coals in these specifications such term also includes blends of coals charged into coke ovens.

Surfactants are organic compounds which contain polar or hydrophylic groups and non-polar or lipophilic groups. Surfactants may be aliphatic or aromatic semi-polar types and may be cationic, anionic, or non-ionic. We have found that surfactants useful in the method of this invention are aliphatic, linear, non-ionic compounds of the alkylphenoxypoly (ethyleneoxy) ethanol-type having the general structure shown below:

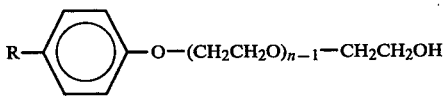

wherein:

R is an alkyl group containing 8 to 12 carbon atoms, and n is an integer between 2 and 30, and has an HLB number between 4 and 18.

The alkyl group is non-polar in nature and contains 8 to 12 and preferably 8 to 9 carbon atoms. The ethylene oxide units are polar groups which are believed to have an affinity for the surfaces of the coals.

The HLB (Hyrophilic-Lipophilic Balance) number is an empirical number developed by the Atlas Powder Company to predict the emulsifying performance of non-ionic surfactants. Surfactants with an HLB number within the range of about 8–18 are oil-in-water emulsifiers and can be used in the method of the invention. Surfactants with an HLB number less than 8 are increasingly soluble in oil whereas those surfactants which have an HLB number greater than 18 are increasingly soluble in water. The surfactants preferred in the method of this invention have an HLB number between about 8 and 16 and most preferred are the surfactants with an HLB number between about 10 and 14.

As noted previously, the surfactants preferred to be used in the method of the invention are of the alkylphenoxypoly (ethyleneoxy) ethanol type having the general formula:

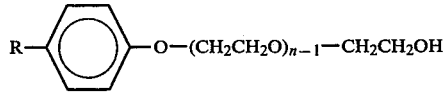

wherein

R is an alkyl group having at least 8 carbon atoms, and n is an integer between 2 and 30, and having an HLB number between 4 and 18. Typical examples of such surfactants are the Igepal types such as Igepal CA-420, Igepal CA-520, Igepal CA-620, and the nonylphenoxypoly (ethyleneoxy) ethanols, Igepal CO-210, Igepal CO-430, Igepal CO-520, Igepal CO-530, Igepal CO-630, Igepal RC-520 and Igepal RC-630, manufactured by the GAF Corporation, Chemical Div., 140 W. 51st Street, New York, NY 10020.

For the surfactant to be usable it should be low in water solubility, have the necessary surface tension characteristics and must have a viscosity when in a 5 to 20 weight percent aqueous dispersion whereby it can flow relatively freely and be sprayed onto the surfaces of the coals. All the surfactants listed above meet these criteria. Two of the most effective surfactants have an alkyl group of 8 carbon atoms and n=5 as typified by Igepal CA-520 and an alkyl group of 9 carbon and n=6 as typified by Igepal CO-530.

Turning now to the FIGURE of the invention which is a graph showing the increase in the wet bulk density of coals containing about 8 weight percent moisture attained by spraying a surfactant equivalent to 1.5, 2 and 2.5 pounds of the surfactant per ton of coal (0.68, 0.91 and 1.13 kg of surfactant per 907.2 kg of coal) onto the surfaces of the coals. The surfactants are characterized by HLB numbers within the range of 4 and 18. Three surfactants had an alkyl group (R) having 8 and three had an alkyl group (R) of 9 carbon atoms. To conduct the experiment, a blend of coals having a size consist of 100 weight percent $-\frac{1}{4}$ inch (6.35 mm) and at least 80 weight percent $-6$ mesh (3.36 mm) and a moisture content of about 4 weight percent was made. The blend of coals was divided into lots of 1000 pounds (453.6 kg) each. The lots were then further subdivided into equal lots of 25 pounds each (11.34 kg). Each of such lots was placed in a batch ribbon blender and mixed with water to increase the moisture content to at least about 8 weight percent. Additionally, sufficient aqueous dispersion equivalent to 1.5, 2 and 2.5 pounds of surfactant per ton of coal (0.68, 0.91 and 1.13 kg of surfactant per 907.2 kg of coal), respectively, was sprayed onto the lots of coal blends.

After blending, each lot of treated coal blends was then placed in a Koppers cone and was allowed to flow into the 0.25 cubic foot (0.01 cubic meter) test box. The coal was leveled and the box weighed. Duplicate bulk density tests were run and the average of the runs obtained. The ASTM D291-60 (adopted as a standard in 1975) bulk density was then determined, based on a correlation between such test and the 0.25 cubic foot (0.01 cubic meter) test. The results are shown on the graph. Curve A shows the wet bulk density of the blends of coal after the moisture content was raised to at least 8 weight percent. The wet bulk density was about 45 pounds per cubic foot (720 kg per cubic meter).

Curves B, C and D show the increase in wet bulk density of the coals when an aqueous dispersion containing 15 weight percent surfactant of a surfactant having an R value of 9 carbon atoms was sprayed onto the blend of coals in quantities equivalent to 1.5, 2 and 2.5 pounds of surfactant per ton of coal (0.68, 0.91 and 1.13 kg respectively per 907.2 kg of coal). Curves B', C' and D' show the increase in wet bulk density of the coals when quantities of an aqueous dispersion containing 15 weight percent surfactant of a surfactant containing an R value of 8 carbon atoms were sprayed onto the coals in amounts equivalent to 1.5, 2 and 2.5 pounds of surfactant per ton of coal (0.68, 0.91 and 1.13 kg per 907.2 kg of coal, respectively).

In all cases, there was an increase in bulk density of the blends of coals when the aqueous dispersion of surfactants having an HLB number of 4 were sprayed onto the surfaces of the coals. As can be seen in the graph, there was a tendency of the wet bulk density to level off when aqueous dispersions of surfactants having an HLB number between 4 and 8 were sprayed onto the surfaces of the coals. However, when aqueous dispersions of surfactants having an HLB number of 8 were sprayed, there was a rather sharp increase in the wet bulk density of the coals. The wet bulk density then continued to increase when aqueous dispersions of surfactants having HLB numbers ranging from 10 to 14 were sprayed onto the surfaces of the coals. The wet bulk density began to decrease when aqueous dispersions of surfactants having HLB numbers greater than 14 were sprayed onto the surfaces of the coals. Aqueous dispersions of surfactants having an HLB number as high as 18 also were effective in increasing the wet bulk density of the coals. Aqueous dispersions of surfactants which are characterized by an R value of 8 and 9 and an HLB number between 4 and 18 can be used to realize the advantages of the method. It is, however, preferred to use aqueous dispersions of surfactants which are characterized by an HLB number between 8 and 16 and most preferred to use aqueous dispersions of surfactants which are characterized by an HLB number between 10 and 14.

As shown, quantities of aqueous dispersions of surfactants equivalent to 1.5, 2 and 2.5 pounds of surfactant per ton of coal (0.68, 0.91 and 1.13 kg of surfactant per 907.2 kg of coal, respectively) increase the wet bulk density of the coals. It is preferred to use a quantity equivalent to about 1.5 pounds of surfactant per ton of coal (0.68 kg of surfactant per 907.2 kg of coal). The wet bulk density of the coals is increased when at least 2 pounds and more of surfactant per ton of coal (0.91 kg of surfactant per 907.2 kg of coal) are sprayed onto the surfaces of the coals. However, such usage must be based on economic limitations since the increase in wet bulk density is minimal when such relatively large amounts of surfactant are used and based on coking limitations, i.e. too high a bulk density resulting in excessive wall pressures.

The wet bulk density of coking coals containing between 6 and 13 weight percent moisture can be increased from between about 42 and 45 pounds per cubic foot (672 and 720 kg per cubic meter) to an optimum level of between about 47 and 50 pounds per cubic foot (753 and 801 kg per cubic meter) and can be maintained and controlled at these levels by spraying a predetermined amount of an aqueous dispersion of a surfactant unto the surfaces of the coals. The surfactant is an alkylphenoxypoly (ethyleneoxy) ethanol-type having a general formula:

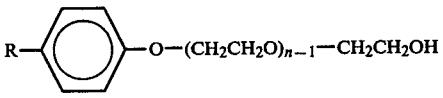

wherein:

R is an alkyl group having at least 8 carbon atoms, n is an integer between 2 and 30, and is characterized by an HLB number between about 4 and 18. The surfactant is sprayed onto the surfaces of the coals in the form of an aqueous dispersion containing about a 5 to 20 weight percent surfactant. An amount of the aqueous dispersion equivalent to between about 0.5 and 1.5 gallons per ton of coals (1.89 L to 5.68 L per 907.2 kg. of coals) is applied to the surfaces of the coals.

The parameters, i.e. R value, HLB number, percent aqueous dispersion, moisture content of the coals and the amount of surfactant sprayed onto the surfaces of the coals are inter-related. To increase the wet bulk density of coking coals containing low moisture contents, for example 6 to 10 weight percent, surfactants having an R value of between 8 or 9 and an HLB number of 8 to 10 can be used. Under these conditions, an aqueous dispersion of between 5 and 20 weight percent surfactant may be applied at a rate between 0.5 and 1.0 gallons of dispersion per ton of coal (1.89 L and 3.78 L per 907.2 kg of coal) to obtain the desired wet bulk density of about 48 pounds per cubic foot (769 kg per cubic meter). If the surfactant has an HLB number between 10 and 14 a lesser amount of surfactant may be required or a lesser amount of a more concentrated aqueous dispersion may be used. However, all the parameters should be within the broad ranges disclosed herein for any benefits of the invention to be realized.

In a first specific example of the invention, three high volatile coking coals and one low volatile coking coal were pulverized and mixed together to form a blend weighing 1000 pounds (453.6 kg). The blend of coals had a size constant of 100 weight percent, $-\frac{1}{4}$ inch (6.35 mm) and 80 weight percent, $-6$ mesh (3.36 mm) and 15 weight percent $-100$ mesh (0.149 mm). In these specifications all mesh sizes are U.S.S. Standard Sieve Series unless otherwise noted. The blend had a moisture content of about 8 weight percent and a bulk density of 45 pounds per cubic foot (720 kg per cubic meter). The blend was divided into equal lots, each weighing 25 pounds (11.34 kg).

A 15 weight percent aqueous dispersion of Igepal CA-520, an alkylphenoxypoly (ethyleneoxy) ethanol having an R value of 8 and an HLB number 10 was made by mixing 150 ml of the surfactant with 850 ml of water. The aqueous dispersion was sprayed onto the surfaces of the coals in amounts to equal 0.05 weight percent surfactant per ton of coal (0.45 kg per 907.2 kg of coal); 0.08 weight percent surfactant per ton of coal (0.68 kg per 907.2 kg of coal) and 0.10 weight percent surfactant per ton of coal (0.907 kg per 907.2 kg of coal). The coals were found to have a wet bulk density of 47.5 pounds per cubic foot (761 kg per cubic meter), 48 pounds per cubic foot (769 kg per cubic meter), and 49 pounds per cubic foot (793 kg per cubic meter), respectively.

In a second specific example of the invention, several lots of 25 pounds (11.34 kg) of the blend of coals as prepared in the first specific example above were sprayed with aqueous dispersions containing 15 weight percent of Igepal CO-430, Igepal CO-520 and Igepal CO-630. The surfactants are alkylphenoxypoly (ethyleneoxy) ethanols having R values of 9 and HLB numbers 8, 10 and 12, respectively. The application rate was 0.68 kg of surfactant per 907.2 kg of coal. The increases in bulk density of the coals are shown below:

| | Wet Bulk Density - Pounds per cubic foot (Kg per cubic meter) | |
|---|---|---|
| | Before Spraying | After Spraying |
| Igepal CO-430 | 44.7 (716) | 47.3 (758) |
| Igepal CO-520 | 44.8 (718) | 48.1 (771) |
| Igepal CO-630 | 44.5 (713) | 48.5 (777) |

From the results shown above, it is clear that the application of the aqueous dispersion to the surfaces of the coals resulted in an increase of between 6 and 9 percent in the wet bulk density of the coals.

In still another specific example of the invention, an aqueous dispersion containing approximately 15 weight percent Igepal RC-630 was prepared. Igepal RC-630 is a dodecylphenoxypoly (ethyleneoxy) ethanol, contains 9 moles of ethylene oxide, has an R group of 12 and an HLB number 10. This aqueous dispersion was sprayed onto a blend of four coals prepared to the specifications previously stated herein in the first specific example. The application rates were 0.5 pounds (0.227 kg), 1.0 pounds (0.453 kg), 2.0 pounds (0.907 kg), and 2.5 pounds (1.135 kg) of surfactant per ton (907.2 kg) of coal. The increases in wet bulk density of the coals containing eight percent moisture as shown below:

| Application Rate of RC-630 | | Untreated Wet Bulk Density | | Treated Wet Bulk Density | |
|---|---|---|---|---|---|
| Lbs/Ton of Coal | Gm/Kg of Coal | Lbs/Cubic Ft. | Kg/Cubic Meter | Lbs/Cubic Ft. | Kg/Cubic Meter |
| 0.5 | 0.25 | 44.9 | 719 | 49.3 | 790 |
| 1.0 | 0.50 | 44.8 | 718 | 49.5 | 793 |
| 2.0 | 1.00 | 44.9 | 719 | 49.8 | 798 |
| 2.5 | 1.25 | 44.9 | 719 | 50.5 | 809 |

From the results above, it is clear that the application of surfactant onto the surfaces of the coals resulted in an increased wet bulk density. At application rates of as little as 0.5 lbs. (0.227 kg) per ton (907.2 kg) of coal, the use of the twelve carbon alkyl group surfactant increased the wet bulk density by approximately 10 percent. At application rates of 2.5 lbs. (1.135 kg) per ton (907.2 kg) of coal the increase in wet bulk density is about 12 percent.

In still another specific example of the invention, an aqueous dispersion containing 15 weight percent Igepal CA-520 was prepared. The chemical composition of Igepal CA-520 was described previously herein. In this example, the aqueous dispersion was sprayed onto a coal of varying moisture in the range of 6 to 9 weight percent. The rate of application was constant and equivalent to 1.5 lbs. (0.68 kg) per ton (907.2 kg) of coal treated. The coal was prepared to the same specifications as stated previously herein. The results of this test are shown below:

| Coal Moisture Weight % | Wet Bulk Density Untreated | | Wet Bulk Density, Treated With 1.5 Lbs./Ton of CA-520 | |
|---|---|---|---|---|
| | Lbs./Cu. Ft. | Kg/Cu. Meter | Lbs./Cu. Ft. | Kg/Cu. Meter |
| 6 | 47.8 | 766 | 49.2 | 788 |
| 7 | 46.0 | 737 | 49.2 | 788 |
| 8 | 45.5 | 729 | 50.0 | 801 |
| 9 | 45.5 | 729 | 50.4 | 807 |

As shown, the wet bulk density of the untreated coking coals is reduced with increasing moisture. The effect of this moisture on bulk density is a reduction of about five percent (766 to 729 kg/cubic meter). At the same moisture contents, the wet bulk densities after treatment with surfactants remained relatively constant and, in fact, increased slightly (about 2%) at the higher moisture ranges. From the results above, it is clear that the application of surfactants results in a controllable, optimum wet bulk density for coke ovens.

It can be seen, therefore, that the present invention is an easy and effective means to increase the bulk density of moist coal containing fairly high moisture contents in the range of 6 to 13 weight percent by applying a particular surfactant composition as an aqueous dispersion to the coal in an amount of between 0.5 to 2.5 pounds of surfactant per ton of coal (0.227 kg to 1.135 kg per 907.2 kg), as set forth in the appended claims.

We claim:

1. An improved method for increasing the wet bulk density of moist coking coals charged to coke ovens to an optimum level and controlling and maintaining the wet bulk density of the coals in the moisture range of 6 to 13 weight percent at the optium level wherein the coals are prepared from raw coals which are treated and washed in coal preparation plants and crushed in the coke plants, the improvement comprising;

(a) preparing an aqueous dispersion containing between about 5 and 20 weight percent of an aliphatic, linear, non-ionic compound of an alkylphenoxypoly (ethyleneoxy) ethanol surfactant having a general structure

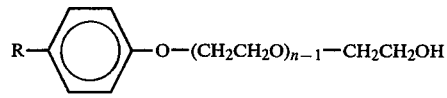

wherein:

R is an alkyl group containing between 8 and 12 carbon atoms, and n is an integer between 2 and 30, where said surfactant is characterized by an HLB number within the range of about 8 and 16, and (b) spraying the aqueous dispersion on the surfaces of the coals in amounts equivalent to between about 0.5 and 2.5 pounds of the surfactant per ton of coals (0.227 and 1.135 kg. of surfactant per 907.2 kg of coals) to increase and maintain the wet bulk density thereof at a level between about 47 and 50 pounds per cubic foot, as determined by standard ASTM D291-60.

2. The method of claim 1 wherein the surfactant has an R value between 8 and 9 carbon atoms.

3. The method of claim 1 wherein the surfactant has an R value of 8.

4. The method of claim 1 wherein the surfactant has an R value of 9.

5. The method of claim 1 wherein the surfactant has an R value of 12.

6. The method of claim 1 wherein the surfactant has an HLB number between 10 and 14.

7. The method of claim 1 wherein the aqueous dispersion contains about 10 to 15 weight percent surfactant.

8. The method of claim 1 wherein the aqueous dispersion is sprayed onto the surfaces of the coals in amounts equivalent to about 0.5 pound of surfactant per ton of coals (0.227 kg of surfactant per 907.2 kg of coals).

* * * * *